US009581172B2

(12) United States Patent
Kanbara et al.

(10) Patent No.: US 9,581,172 B2
(45) Date of Patent: Feb. 28, 2017

(54) METHOD FOR MANUFACTURING TURBOCHARGER BEARING HOUSING, AND TURBOCHARGER BEARING HOUSING

(71) Applicant: TAIHO KOGYO CO., LTD., Toyota-shi (JP)

(72) Inventors: Satoru Kanbara, Toyota (JP); Keijiro Maki, Toyota (JP); Kenji Muraoka, Toyota (JP); Yasuhiro Otake, Nishio (JP); Takuya Suzuki, Nishio (JP)

(73) Assignee: TAIHO KOGYO CO., LTD., Toyota-Shi, Aichi (JP)

( * ) Notice: Subject to any disclaimer, the term of this patent is extended or adjusted under 35 U.S.C. 154(b) by 355 days.

(21) Appl. No.: 14/397,268

(22) PCT Filed: Apr. 25, 2013

(86) PCT No.: PCT/JP2013/062199
§ 371 (c)(1),
(2) Date: Oct. 27, 2014

(87) PCT Pub. No.: WO2013/161938
PCT Pub. Date: Oct. 31, 2013

(65) Prior Publication Data

US 2015/0093238 A1 Apr. 2, 2015

(30) Foreign Application Priority Data

Apr. 27, 2012 (JP) ..... 2012-103633

(51) Int. Cl.
*F04D 29/40* (2006.01)
*F04D 29/58* (2006.01)
(Continued)

(52) U.S. Cl.
CPC ..... *F04D 29/403* (2013.01); *B22C 9/02* (2013.01); *B22C 9/10* (2013.01); *B22C 9/108* (2013.01);
(Continued)

(58) Field of Classification Search
CPC ..... F01D 25/125; F01D 25/14; F01D 25/16; F04D 29/403; F04D 29/582;
(Continued)

(56) References Cited

U.S. PATENT DOCUMENTS 5,947,682 A * 9/1999 Moon ..... B22C 9/24 415/200
6,315,520 B1 * 11/2001 Haje ..... B22C 9/10 415/178
(Continued)

FOREIGN PATENT DOCUMENTS

DE 10 2010 047 952 A1 4/2012
JP 61-9527 U 1/1986
(Continued)

OTHER PUBLICATIONS

The extended European Search Report issued on Nov. 10, 2015, by the European Patent Office in corresponding European Patent Application No. 13780558.6-1353. (6 pages).
(Continued)

*Primary Examiner* — Igor Kershteyn
(74) *Attorney, Agent, or Firm* — Buchanan Ingersoll & Rooney PC

(57) ABSTRACT

There is provided a method for manufacturing a turbocharger bearing housing which can prevent a collapsible core from being damaged when molten metal is cast in the mold. The method for manufacturing a bearing housing of a turbocharger is that the bearing housing of the turbocharger is formed with a cooling passage for circulating cooling
(Continued)

liquid by casting using a collapsible core. The collapsible core includes the end part forming portions (a one end forming portion and an other end forming portion) corresponding to the end portions of the cooling passage and having a substantially elliptical cross-section, and a fixing portion holding the end part forming portions and being embedded in a mold and fixed to the mold.

8 Claims, 10 Drawing Sheets

(51) Int. Cl.

| | |
|---|---|
| ***B22C 9/10*** | (2006.01) |
| ***B22C 9/24*** | (2006.01) |
| ***B22D 25/02*** | (2006.01) |
| ***B22C 9/02*** | (2006.01) |
| ***F01D 25/12*** | (2006.01) |
| ***F01D 25/14*** | (2006.01) |
| ***F01D 25/16*** | (2006.01) |
| ***B22C 21/14*** | (2006.01) |

(52) U.S. Cl.
CPC ..... *B22C 9/24* (2013.01); *B22C 21/14* (2013.01); *B22D 25/02* (2013.01); *F01D 25/125* (2013.01); *F01D 25/14* (2013.01); *F01D 25/16* (2013.01); *F04D 29/582* (2013.01); *F05D 2220/40* (2013.01); *F05D 2230/21* (2013.01); *F05D 2260/232* (2013.01)

(58) Field of Classification Search
CPC ..... F05D 2220/40; F05D 2230/21; F05D 2260/232; B22C 9/02; B22C 9/10; B22C 9/108; B22C 9/24; B22C 21/14; B22D 25/02
See application file for complete search history.

(56) References Cited

U.S. PATENT DOCUMENTS

| | | | | |
|---|---|---|---|---|
| 6,415,846 | B1 * | 7/2002 | O'Hara | B22C 9/22 164/137 |
| 6,945,046 | B2 * | 9/2005 | Allmang | F01D 9/026 415/136 |
| 8,347,499 | B2 * | 1/2013 | Grzondziel | B22D 25/02 164/460 |
| 8,827,635 | B2 * | 9/2014 | Kratschmer | F01D 17/16 415/159 |
| 8,951,007 | B2 * | 2/2015 | Botsch | F01D 25/246 415/158 |
| 2013/0272857 | A1 | 10/2013 | Böning et al. | |

FOREIGN PATENT DOCUMENTS

| | | | |
|---|---|---|---|
| JP | 63-158544 | U | 10/1988 |
| JP | 7-30990 | Y2 | 7/1995 |
| JP | 9-310620 | A | 12/1997 |

OTHER PUBLICATIONS

International Search Report (PCT/ISA/210) mailed on Jul. 30, 2013, by the Japanese Patent Office as the International Searching Authority for International Application No. PCT/JP2013/062199.

* cited by examiner

METHOD FOR MANUFACTURING TURBOCHARGER BEARING HOUSING, AND TURBOCHARGER BEARING HOUSING

TECHNICAL FIELD

The present invention relates to a technique of a method for manufacturing a turbocharger bearing housing in which a cooling passage for circulating cooling liquid is formed by casting using a collapsible core, and a technique of a turbocharger bearing housing.

BACKGROUND ART

Conventionally, there has been publicly known a turbocharger bearing housing in which a cooling passage for circulating cooling liquid is formed. Such a turbocharger bearing housing is disclosed, for example, in Japanese Patent Application Laid-Open Publication No. Hei. 9-310620.

The turbocharger bearing housing disclosed in Japanese Patent Application Laid-Open Publication No. Hei. 9-310620 is manufactured by casing. Further, the turbocharger bearing housing disclosed in Japanese Patent Application Laid-Open Publication No. Hei. 9-310620 includes the cooling passage for circulating cooling liquid which is formed so as to surround the periphery of a bearing portion turnably supporting a shaft.

In such a conventional turbocharger bearing housing, since the shape of the cooling passage is complicated, normally when the bearing housing is formed by casting, the cooling passage is simultaneously formed by using a collapsible core formed from molding sand and a resin binder.

With reference to FIG. 9 and FIG. 10, description will be given of the disadvantageous points and the solution of the method for manufacturing such a conventional turbocharger bearing housing.

The conventional turbocharger bearing housing is manufactured by casting. As shown in FIG. 9A, a mold 160 used in the casting includes a casting main body portion 162 that is a cavity portion having substantially the same shape as a desired casting (specifically, the turbocharger bearing housing).

A collapsible core 150 for forming the cooling passage inside the bearing housing is disposed inside the casting main body portion 162. The collapsible core 150 includes a circulation forming portion 151, an end part forming portion 152, and a fixing portion 154. The circulation forming portion 151 is formed so as to surround the periphery of the bearing portion turnably supporting the shaft of the turbocharger. The end part forming portion 152 is connected to the vicinity of the upper end portion of the circulation forming portion 151, and is extended upward from the circulation forming portion 151 (to an upper portion of the casting main body portion 162). The fixing portion 154 is connected to the upper end of the end part forming portion 152, and is embedded in and fixed to the mold 160 (the upper portion of the casting main body portion 162) to thereby hold the end part forming portion 152 and the circulation forming portion 151 in a prescribed position. The circulation forming portion 151 and the end part forming portion 152 of the collapsible core 150 form the portions corresponding to the cooling passage formed inside the bearing housing.

In the case where a molten metal 70 is supplied (cast into a mold) via a weir 164 to the inside of the casting main body portion 162, in which the collapsible core 150 configured as above is disposed, of the mold 160, a moment of force is applied to the end part forming portion 152 of the collapsible core 150 by buoyancy applied to the circulation forming portion 151 when the circulation forming portion 151 of the collapsible core 150 is soaked in the molten metal 70 to a certain degree as shown in FIG. 9B. Thereby, the end part forming portion 152 is damaged (broken), which is a disadvantageous point that the bearing housing may not be manufactured.

To solve the above-described problem, as shown in FIG. 10, the method in which the collapsible core 150 is formed with an auxiliary fixing portion 155 is available. The auxiliary fixing portion 155 is connected to the vicinity of the lower end portion of the circulation forming portion 151, and is extended downward from the circulation forming portion 151 (to a bottom portion of the casting main body portion 162). The lower end portion of the auxiliary fixing portion 155 is embedded in and fixed to the mold 160 (the bottom portion of the casting main body portion 162).

The collapsible core 150 is thus formed with the auxiliary fixing portion 155 so that the circulation forming portion 151 is supported in the two directions, namely, the support manner of the collapsible core 150 is a both-end support manner (specifically, the circulation forming portion 151 is supported by the end part forming portion 152 from above, and is supported by the auxiliary fixing portion 155 from below). With this configuration, even if buoyancy is applied to the circulation forming portion 151, the circulation forming portion 151 is supported not only by the end part forming portion 152 but also by the auxiliary fixing portion 155, the collapsible core 150 can be prevented from being damaged.

However, the bearing housing obtained by the manufacturing method (casting method) using the mold 160 and the collapsible core 150 as shown in FIG. 10 is formed with not only holes of the end portion of the cooling passage (specifically, holes formed by the end part forming portion 152) but also unnecessary holes (specifically, holes formed by the auxiliary fixing portion 155). Accordingly, there is a disadvantageous point because of a necessity for inserting a plug so as to block the unnecessary holes.

DISCLOSURE OF INVENTION

Technical Problem

The present invention has been devised to solve the disadvantageous points described above, and an object thereof is to provide a method for manufacturing a turbocharger bearing housing capable of preventing a collapsible core from being damaged when molten metal is cast in the mold and capable of preventing unnecessary holes from being formed in the bearing housing, and the turbocharger bearing housing.

Solution to Problem

The technical problem of the present invention is described above, and the solution to problem will be described hereafter.

The method for manufacturing a turbocharger bearing housing according to the present invention is that a turbocharger bearing housing is formed with a cooling passage for circulating cooling liquid inside thereof by casting using a collapsible core. The collapsible core includes end part forming portions formed so as to correspond to the end portions of the cooling passage and formed so as to have a substantially elliptical cross-section, and a fixing portion holding the end part forming portions and being embedded in a mold and fixed to the mold.

In the method for manufacturing a turbocharger bearing housing according to the present invention, the end part forming portions include a one end forming portion corresponding to one of the end portions of the cooling passage and an other end forming portion corresponding to the other end portion of the cooling passage. The fixing portion holds the one end forming portion and the other end forming portion in a position close to each other. The collapsible core further includes a circulation forming portion which connects the one end forming portion and the other end forming portion and corresponds to a middle portion of the cooling passage. The one end forming portion, the circulation forming portion, and the other end forming portion are formed so as to be one continuous linear form.

In the method for manufacturing a turbocharger bearing housing according to the present invention, each of the end part forming portions is formed so as to have a substantially elliptical cross-section such that a short axis thereof is parallel to a direction in which the one end forming portion and the other end forming portion are lined up.

In the method for manufacturing a turbocharger bearing housing according to the present invention, the collapsible core 50 is disposed such that the fixing portion is disposed on a lower side and the circulation forming portion is disposed on an upper side, and the fixing portion is fixed to a bottom portion of a portion corresponding to the bearing housing in the mold. Then, molten metal is cast in the mold.

In the method for manufacturing a turbocharger bearing housing according to the present invention, a portion corresponding to the bearing housing in the mold is formed with a plurality of weirs for supplying molten metal. At least one of the plurality of weirs is formed in a position in which molten metal supplied from the weir to the portion corresponding to the bearing housing in the mold does not contact with the end part forming portions directly.

A turbocharger bearing housing according to the present invention is formed with a cooling passage for circulating cooling liquid by casting using a collapsible core. Each of end portions of the cooling passage apertured on an outer peripheral surface of the bearing housing is formed so as to have a substantially elliptical cross-section.

In the turbocharger bearing housing according to the present invention, the cooling passage includes both end portions apertured at a position close to each other on the outer peripheral surface of the bearing housing, and a middle portion for connecting the both end portions inside the bearing housing. The both end portions and the middle portion are formed so as to be one continuous linear form.

In the turbocharger bearing housing according to the present invention, each of the both end portions of the cooling passage is formed so as to have a substantially elliptical cross-section such that a short axis thereof is parallel to a direction in which the both end portions are lined up.

Advantageous Effects of the Invention

The advantageous effects of the present invention will be described hereinafter.

In the method for manufacturing a turbocharger bearing housing according to the present invention, the strength of the end part forming portions of the collapsible core can be improved and the end part forming portions can be prevented from being damaged by buoyancy applied to the collapsible core from molten metal.

Further, there is no necessity to increase the amount of a resin binder of the collapsible core or to pass a cored bar to the collapsible core in order to improve the strength of the collapsible core (more specifically, the end part forming portions). Thus, it is possible to prevent the increase of the gas generation amount in association with the increase of the resin binder (furthermore, occurrence of a casting defect), and to prevent the increase of man-hours for passing the cored bar and for removing the cored bar.

Further, it is possible to increase the cross-sectional area of the cooling passage, and thereby sand of the collapsible core can be easily removed from the inside of the cooling passage after molten metal is solidified.

In the method for manufacturing a turbocharger bearing housing according to the present invention, the collapsible core is supported in one direction (specifically, supported at one end), by the portions corresponding to both ends portions of the cooling passage (the one end forming portion and the other end forming portion). Accordingly, it is possible to prevent unnecessary holes from being formed, the unnecessary holes being formed in the bearing housing when the collapsible core is supported in a plurality of directions (for example, supported in two directions, namely supported at both ends, and so on).

Further, since it is possible to prevent the unnecessary holes from being formed in the bearing housing, there is no necessity to use a plug for blocking a hole, a bond for preventing water leakage, and so on for the unnecessary holes. Thus, cost reduction can be achieved. Further, since there is no necessity to form a boss portion for attaching the plug, the plug itself is also unnecessary. Accordingly, the increase of the weight of the bearing housing can be prevented. Further, since there is no necessity to form the boss portion, it is possible to improve the degree of freedom in designing such as enlarging the lubricating oil passage formed in addition to the cooling passage. Further, in the case where the collapsible core is supported in a plurality of directions, the shape of the cooling passage becomes complicated and a dead end portion is formed in the cooling passage. Accordingly, the circulation of cooling liquid is stagnated in the dead end portion, thereby lowering the cooling efficiency of the bearing housing. However, in the bearing housing manufactured by the manufacturing method according to the present invention, since the cooling passage has a simple shape (one linear form having no branch), cooling liquid can be circulated smoothly, and thus the cooling efficiency can be increased.

In the method for manufacturing a turbocharger bearing housing according to the present invention, the strength of the end part forming portions of the collapsible core can be improved while ensuring an interval between the one end forming portion and the other end forming portion, which are adjacent to each other.

In the method for manufacturing a turbocharger bearing housing according to the present invention, when molten metal is cast in the mold, it is possible to reduce buoyancy applied to the circulation forming portion of the collapsible core from molten metal, and further to prevent the collapsible core (specifically, end part forming portions) from being damaged.

In the method for manufacturing a turbocharger bearing housing according to the present invention, when molten metal is supplied from the plurality of weirs, it is possible to reduce a shock (pressure) that the collapsible core receives from the molten metal, and further to prevent the collapsible core (specifically, end part forming portions) from being damaged.

In the turbocharger bearing housing according to the present invention, it is possible to improve the strength of the portions corresponding to the end portions of the cooling passage in the collapsible core, and thereby it is possible to prevent the portions corresponding to the end portions of the cooling passage in the collapsible core, from being damaged by buoyancy applied to the collapsible core from molten metal at the time of casting.

Further, there is no necessity to increase the amount of the resin binder of the collapsible core and to pass the cored bar to the collapsible core in order to improve the strength of the collapsible core (more specifically, the portions corresponding to the end portions of the cooling passage in the collapsible core). Thus, it is possible to prevent the increase of the gas generation amount in association with the increase of the resin binder (furthermore, occurrence of a casting defect), and to prevent the increase of man-hours for passing the cored bar and for removing the cored bar.

Further, it is possible to increase the cross-sectional area of the cooling passage, and thereby sand of the collapsible core can be easily removed from the inside of the cooling passage after molten metal is solidified.

In the turbocharger bearing housing according to the present invention, the collapsible core is supported in one direction (specifically, supported at one end), by the portions corresponding to both end portions of the cooling passage. Accordingly, it is possible to prevent unnecessary holes from being formed, the unnecessary holes being formed in the bearing housing when the collapsible core is supported in a plurality of directions (for example, supported in two directions, namely supported at both ends, and so on).

Further, since it is possible to prevent the unnecessary holes from being formed in the bearing housing, there is no necessity to use a plug for blocking a hole and a bond for preventing water leakage, and so on for the unnecessary holes. Thus, cost reduction can be achieved. Further, since there is no necessity to form a boss portion for attaching the plug, the plug itself is also unnecessary. Accordingly, the increase of the weight of the bearing housing can be prevented. Further, since there is no necessity to form the boss portion, it is possible to improve the degree of freedom in designing such as enlarging the lubricating oil passage formed in addition to the cooling passage.

Further, in the case where the collapsible core is supported in a plurality of directions, the shape of the cooling passage becomes complicated, and a dead end portion is formed in the cooling passage. Accordingly, the circulation of cooling liquid is stagnated in the dead end portion, thereby lowering the cooling efficiency of the bearing housing. However, in the bearing housing according to the present invention, since the cooling passage has a simple shape (one linear form having no branch), cooling liquid can be circulated smoothly, and thus the cooling efficiency can be increased.

In the turbocharger bearing housing according to the present invention, the strength of the portions corresponding to both end portions of the cooling passage in the collapsible core can be improved while ensuring an interval between both end portions, which are adjacent to each other, of the cooling passage.

DESCRIPTION OF EMBODIMENTS

In the following description, in accordance with arrows shown in the figures, a front-back direction, an up-down direction, and a left-right direction are defined individually.

Figure 1:
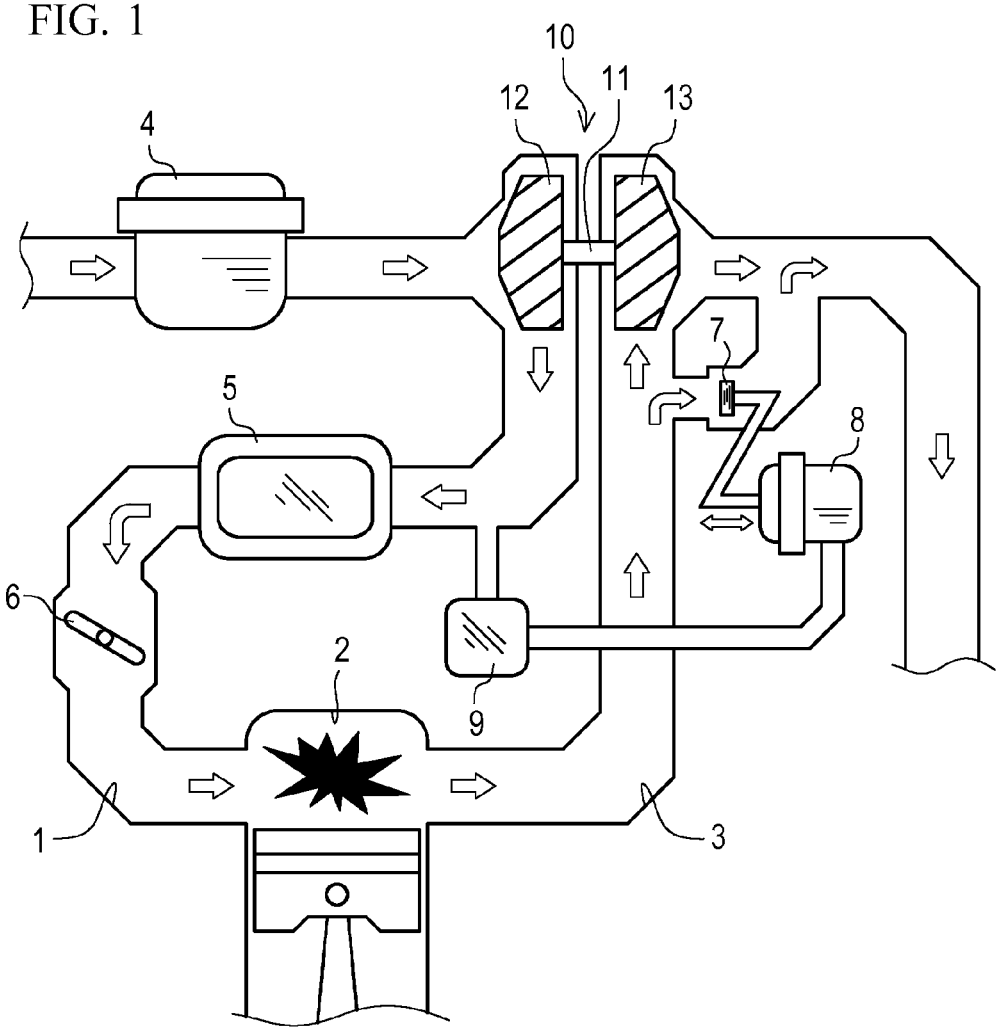
FIG. 1 is a schematic view showing an overview of operation for a turbocharger using a bearing housing manufactured by the manufacturing method according to the present invention.

With reference to FIG. 1, description will be given of an overview of operation for a turbocharger 10 using a bearing housing 20 (refer to FIG. 2 and the like) which is one embodiment of the bearing housing according to the present invention.

The turbocharger 10 is for feeding compressed air into a cylinder 2 of an engine. The air is supplied to the cylinder 2 via an intake passage 1. The air sequentially passes through an air cleaner 4, the turbocharger 10, an intercooler 5, and a throttle valve 6 which are disposed along the intake passage 1, and then the air is supplied to the cylinder 2. At this time, since a compressor 12 of the turbocharger 10 compresses the air, much more air can be fed into the cylinder 2.

High-temperature air (exhaust) after burning inside the cylinder 2 is discharged via an exhaust passage 3. At this time, the exhaust rotates a turbine 13 of the turbocharger 10. The turbine 13 is connected to the compressor 12 via a shaft 11 so that air inside the intake passage 1 can be compressed by transmitting the rotation of the turbine 13 to the compressor 12.

On the upstream side of the turbine 13, the exhaust passage 3 is branched and a passage not via the turbine 13 is formed separately. The passage can be opened/closed by a waste gate valve 7. The waste gate valve 7 is driven to open/close by an actuator 8. Further, operation of the actuator 8 is controlled by a negative pressure generating mechanism 9 which is configured by a solenoid valve and the like. The waste gate valve 7 is opened/closed by the actuator 8 so that flow rates of exhaust to be fed to the turbine 13 can be adjusted.

Figure 2B:
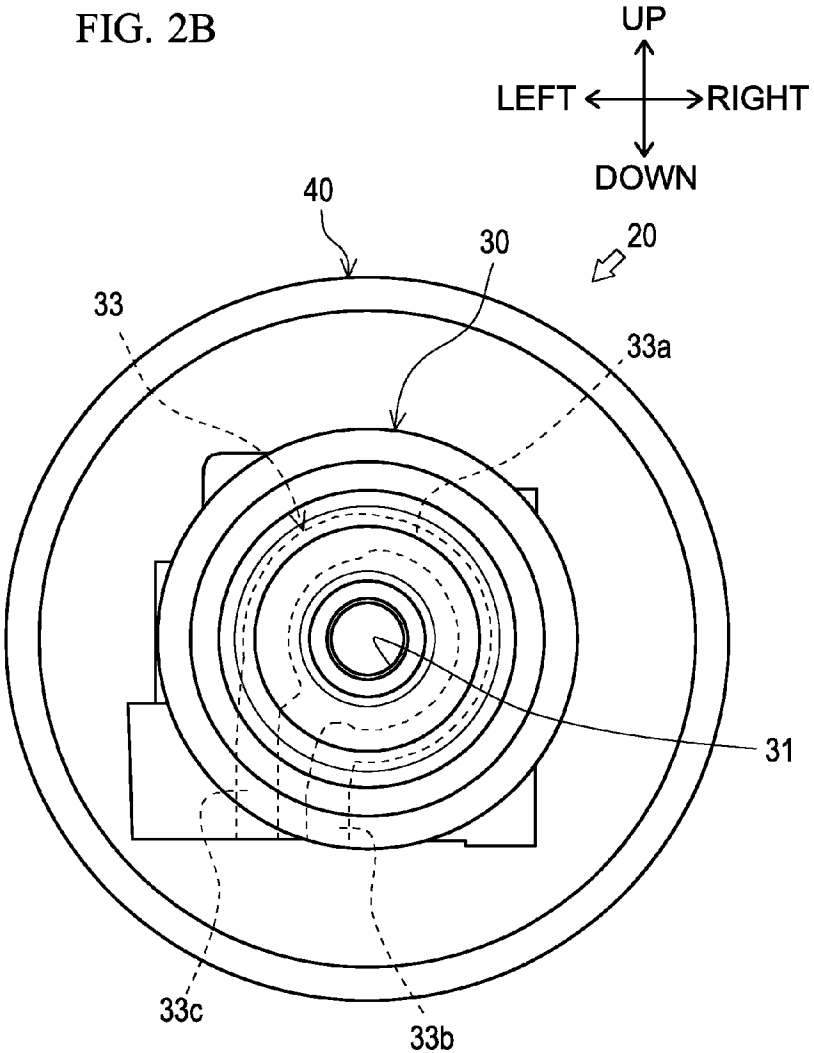
FIG. 2B is a front view of the bearing housing.
Figure 2A:
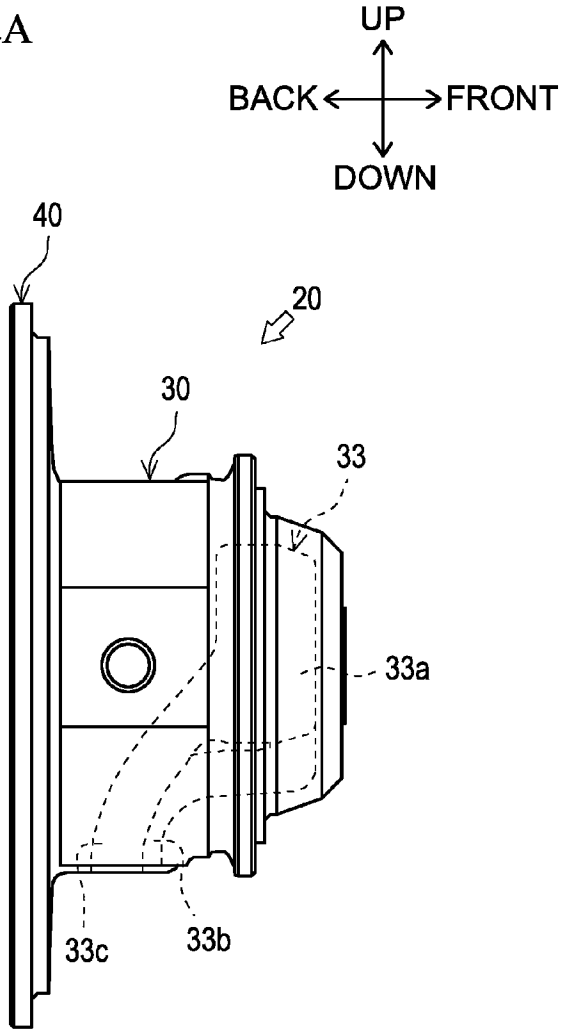
FIG. 2A is a right-side view of the hearing housing.
Figure 3B:
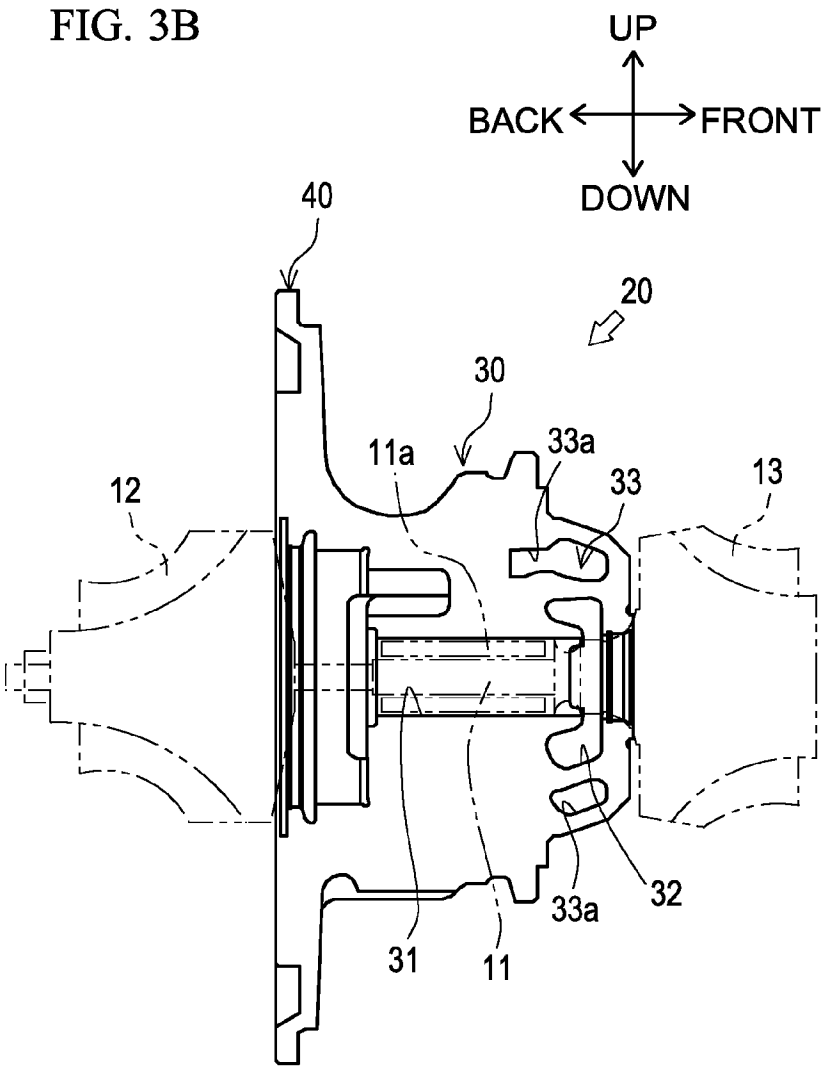
FIG. 3B is a cross-sectional view of the bearing housing taken along line A-A of FIG. 3A.
Figure 3A:
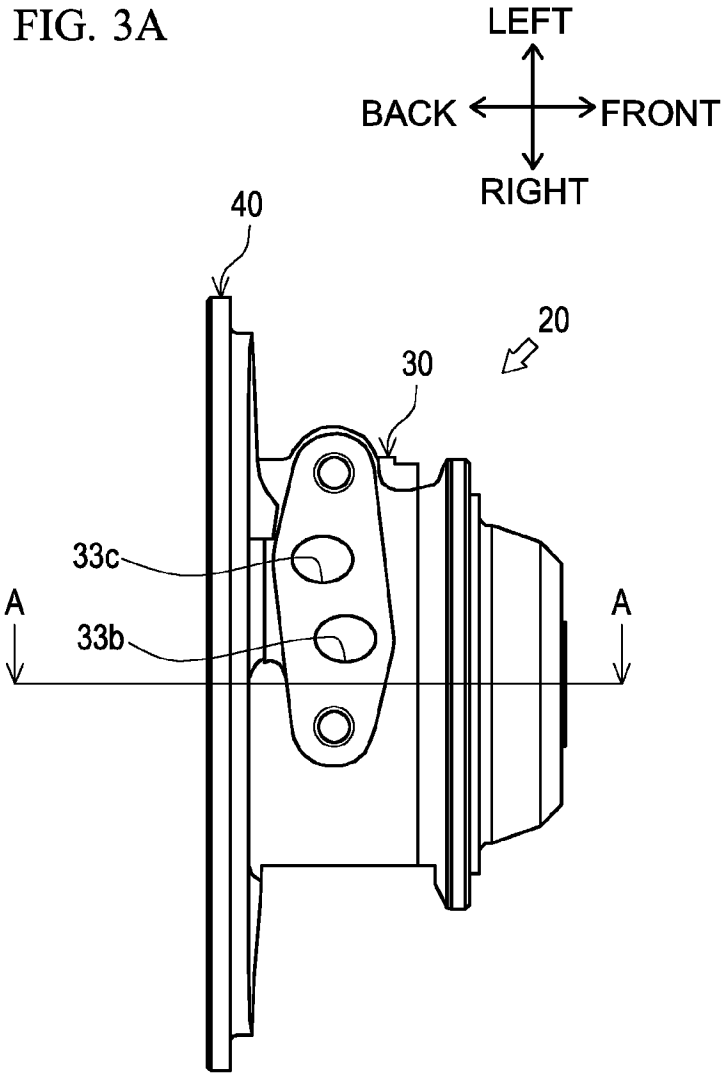
FIG. 3A is a bottom view of the bearing housing.

Next, with reference to FIG. 2 and FIG. 3, description will be given of a configuration of the bearing housing 20.

The bearing housing 20 includes the shaft 11, and turnably supports the shaft 11. The shaft 11 is disposed so as to penetrate through the bearing housing 20 in the front-back direction, and is turnably supported by the bearing housing 20 via a bearing 11*a*. Further, the compressor 12 is disposed at the back of the bearing housing 20, and the turbine 13 is disposed at the front of the bearing housing 20 (refer to FIG. 3B). The bearing housing 20 mainly includes a body portion 30 and a flange portion 40.

The body portion 30 is a portion formed into a substantially cylindrical shape such that the axis thereof is directed toward the front-back direction. In the body portion 30, a bearing portion 31, a lubricating oil passage 32, and a cooling passage 33 are formed.

The bearing portion 31 is a portion which turnably supports the shaft 11 via the bearing 11*a*. The bearing portion 31 is configured by a through-hole formed so as to penetrate through the body portion 30 in the front-back direction. More specifically, the bearing portion 31 is formed so as to communicate the front surface of the body portion 30 with the back surface of the body portion 30, and additionally formed to be parallel to the front-back direction.

The lubricating oil passage 32 is for supplying lubricating oil for lubricating a sliding portion (the bearing portion 31 and so on) between the bearing housing 20 and the shaft 11 to the inside of the bearing housing 20. The lubricating oil passage 32 is formed so as to communicatively connect an outer peripheral surface of the bearing housing 20 with the sliding portion (the bearing portion 31 and so on) between the bearing housing 20 and the shaft 11.

In the lubricating oil passage 32 configured as above, the lubricating oil supplied from the outside of the bearing housing 20 is supplied to the sliding portion (the bearing portion 31 and so on) between the bearing housing 20 and the shaft 11 so that the lubricating oil lubricates and cools the sliding portion.

The cooling passage 33 is for circulating cooling liquid for cooling the bearing housing 20 into the inside of the bearing housing 20. The cooling passage 33 mainly includes a circular circulation portion 33*a*, a first end portion 33*b*, and a second end portion 33*c*.

The circular circulation portion 33*a* is configured as a middle portion of the cooling passage 33 inside the body portion 30. The circular circulation portion 33*a* is formed in a neighborhood of a front end portion of the body portion 30. The circular circulation portion 33*a* is formed into a substantially arc shape so as to surround the bearing portion 31 in the front view.

The first end portion 33*b* is configured as one of the end portions of the cooling passage 33. The first end portion 33*h* is opened at a substantially central portion in the left-right direction of a bottom surface (lower surface) of the body portion 30, and is formed so as to extend forward and upward from the opening portion. The front upper end of the first end portion 33*b* communicates with one end of the circular circulation portion 33*a*.

The second end portion 33*c* is configured as the other end portion of the cooling passage 33. The second end portion 33*c* is opened on just the left side of the first end portion 33*b* of the bottom surface (lower surface) of the body portion 30, and is formed so as to extend forward and upward from the opening portion. The front upper end of the second end portion 33*c* communicates with the other end of the circular circulation portion 33*a*.

Thus, each of the end portions of the first end portion 33*b*, the circular circulation portion 33*a*, and the second end portion 33*c* is sequentially communicated so that the first end portion 33*b*, the circular circulation portion 33*a*, and the second end portion 33*c* (the cooling passage 33) are formed so as to be one continuous linear form having no branch portion.

Each of the cross-sections of the first end portion 33*b* and the second end portion 33*c* has a substantially elliptical shape. More specifically, each of the cross-sections of the first end portion 33*h* and the second end portion 33*c* has a substantially elliptical shape such that the long axis thereof is substantially parallel to the front-back direction, and the short axis thereof is substantially parallel to the left-right direction (specifically, the direction in which the first end portion 33*b* and the second end portion 33*c* are lined up).

In the cooling passage 33 configured as above, cooling liquid supplied from the outside of the bearing housing 20 is supplied from the first end portion 33*b* to the inside of the bearing housing 20. After circulating into the inside of the circular circulation portion 33*a*, the cooling liquid is discharged from the second end portion 33*c* to the outside of the bearing housing 20. The circular circulation portion 33*a* is formed so as to surround the bearing portion 31 so that the cooling liquid circulating into the inside of the circular circulation portion 33*a* can cool the bearing portion 31 effectively.

The flange portion 40 is a portion formed into a substantially disc shape such that the plate surface thereof is directed toward the front-back direction. The flange portion 40 is integrally formed with the body portion 30 on the back end periphery of the body portion 30.

Next, with reference to FIGS. 4 to 8, description will be given of the method for manufacturing the bearing housing 20 configured as above.

Figure 4:
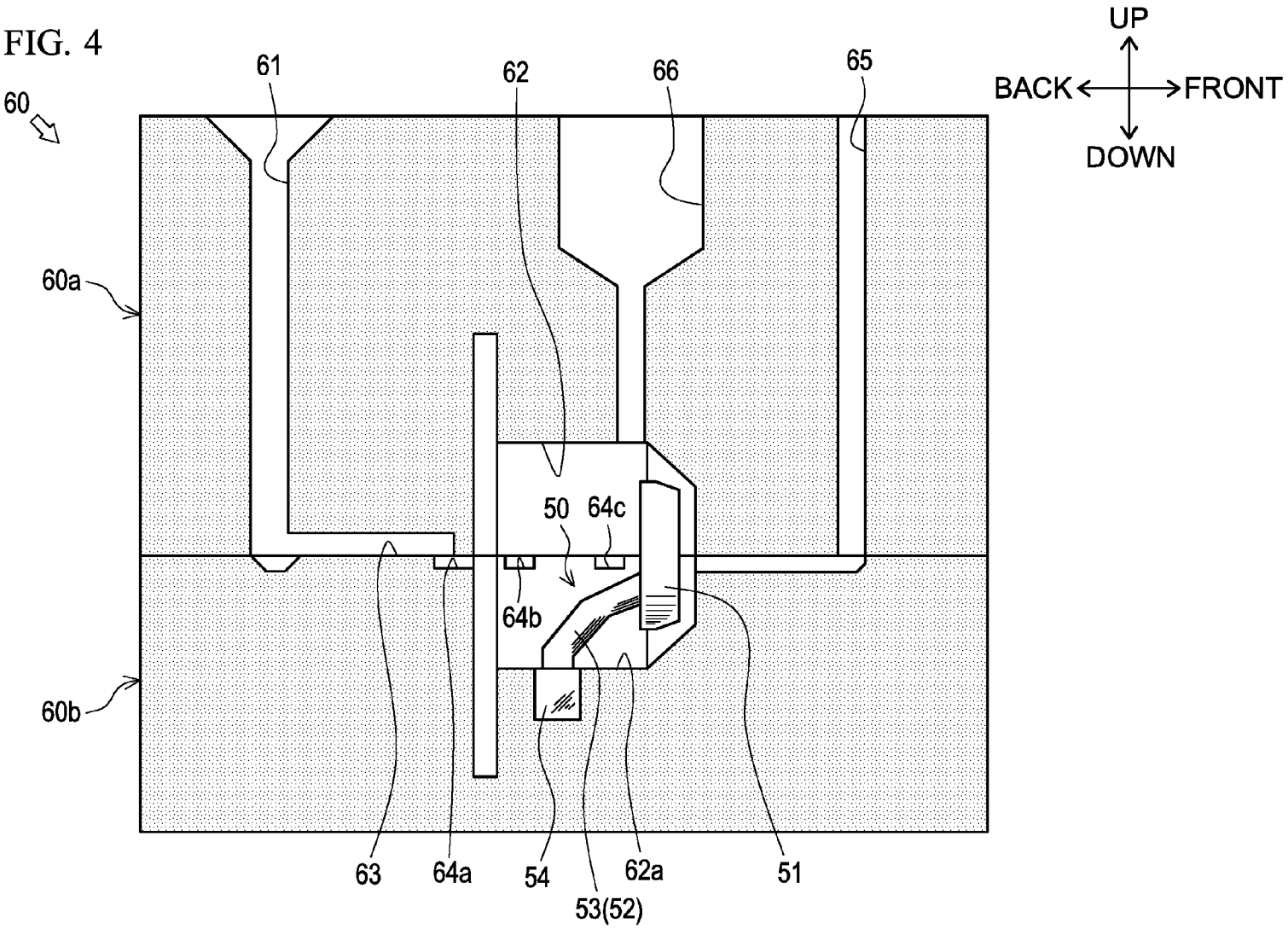
FIG. 4 is a sectional side view schematically showing an overview of a configuration of a mold.
Figure 5:
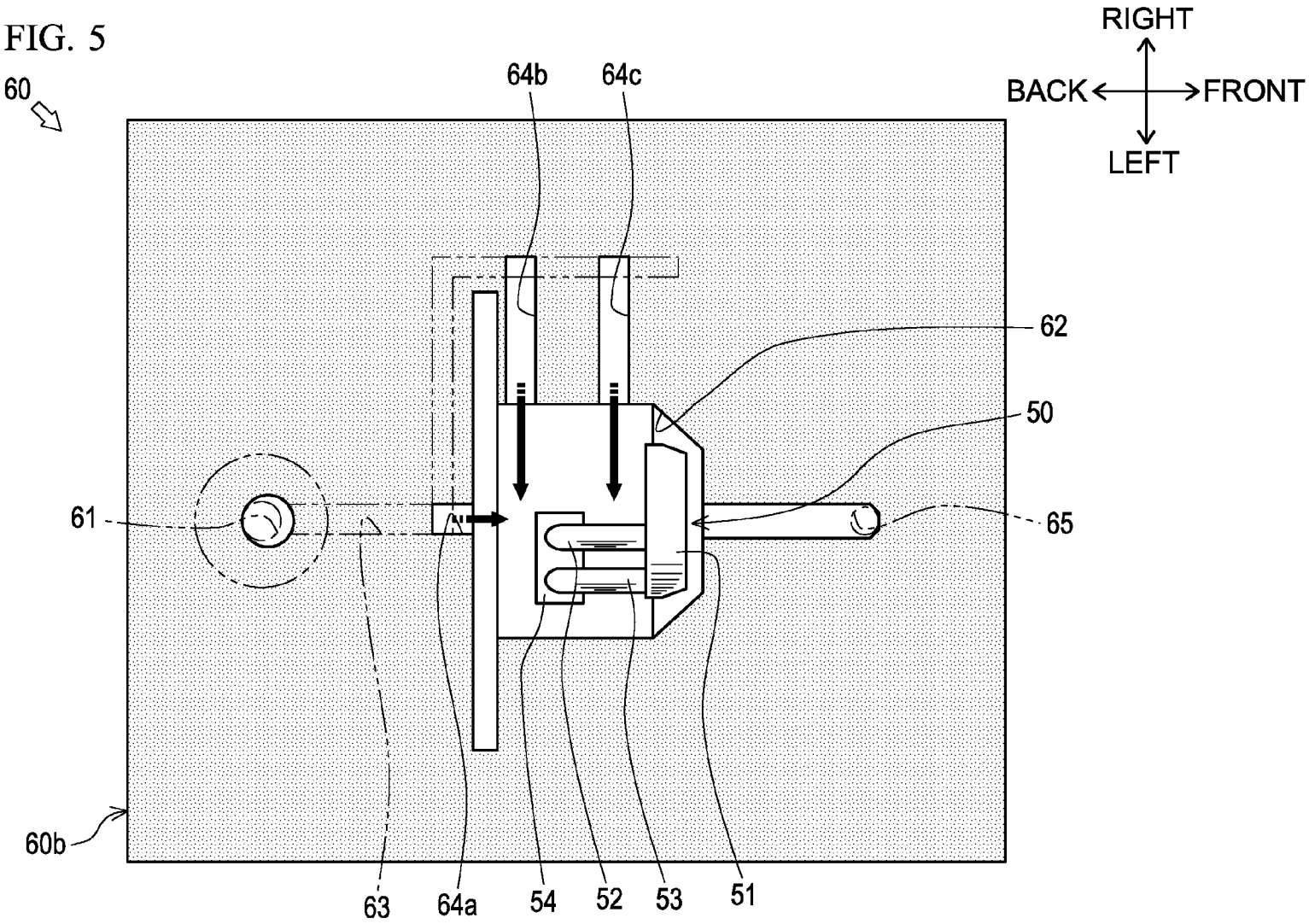
FIG. 5 is a plan view schematically showing an overview of a configuration of the mold (specifically, lower mold).
Figure 6:
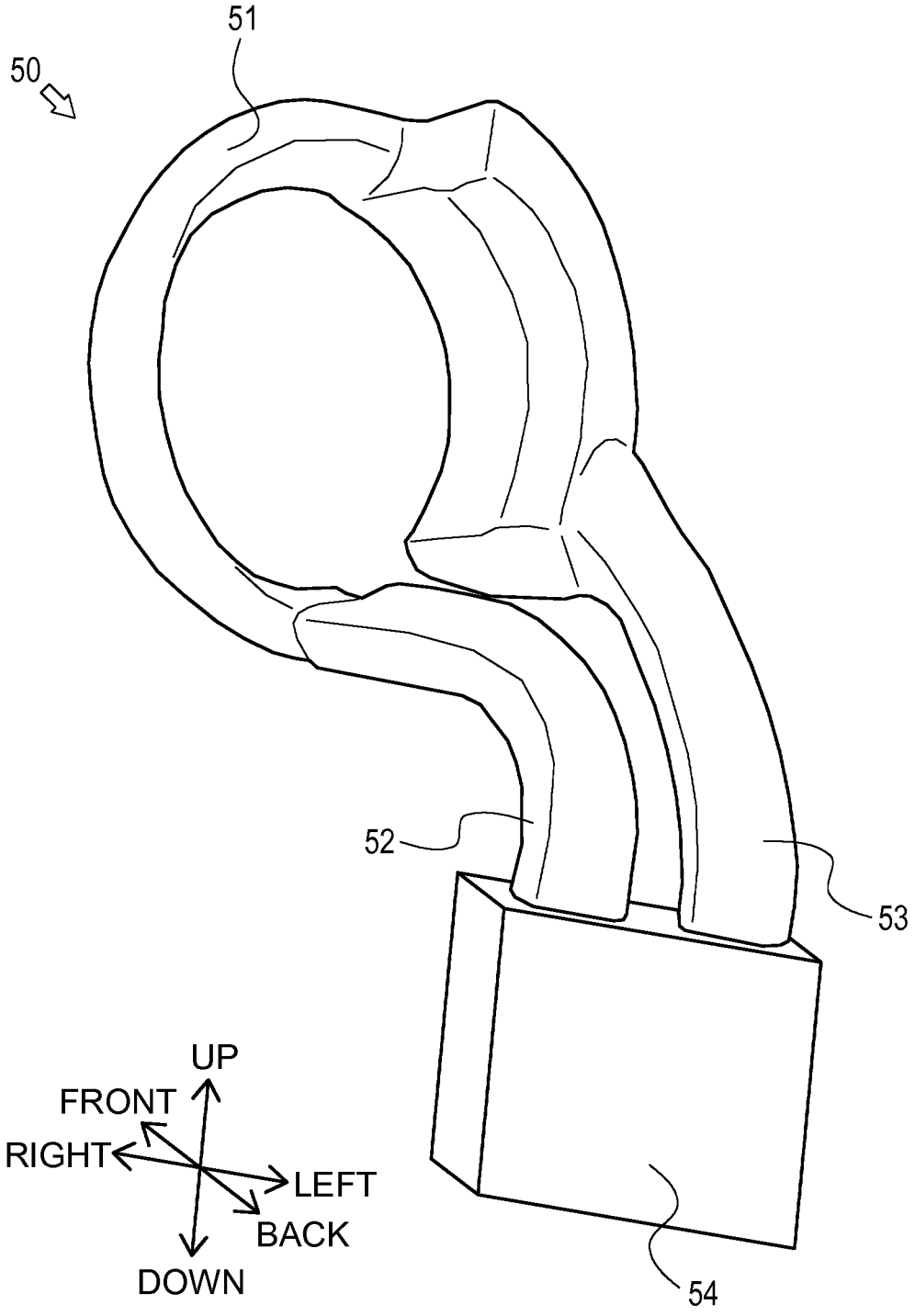
FIG. 6 is a perspective view of a collapsible core.

The bearing housing 20 is manufactured by casting. With reference to FIG. 4 and FIG. 5, description will be given of a configuration of a mold 60 used at the time of manufacturing (casting) the hearing housing 20.

The mold 60 is a sand mold which is used for casting the bearing housing 20. The mold 60 has an upper mold 60*a* and a lower mold 60*b*. The mold 60 mainly includes a sprue 61, a casting main body portion 62, a runner 63, a first weir 64*a*, a second weir 64*b*, a third weir 64*c*, a gas vent portion 65, and a riser portion 66.

FIG. 5 is a plan view showing only the lower mold 60*b* in the mold 60, however, the sprue 61, the runner 63, and the gas vent portion 65 which are formed in the upper mold 60*a* are shown by a chain double-dashed line for convenience of description.

The sprue 61 is used as an inlet when molten metal is poured into the mold 60. The sprue 61 is formed so as to extend downward from an upper surface of the upper mold 60*a*.

The casting main body portion 62 is a cavity portion for forming the bearing housing 20. The casting main body portion 62 is formed in the upper mold 60*a* and the lower mold 60*b* so as to have substantially the same shape as the bearing housing 20.

The runner 63 is a passage for circulating molten metal poured from the sprue 61 into a prescribed position. The runner 63 is extended from a lower end portion of the sprue 61 to a prescribed position. More specifically, the runner 63 is extended from the lower end portion of the sprue 61 to the just behind of the casting main body portion 62, and further extended so as to bypass the casting main body portion 62 in the right direction toward the front direction (refer to FIG. 5).

The first weir 64*a* is a passage for supplying molten metal circulated through the runner 63 to the inside of the casting main body portion 62. The first weir 64*a* is formed in the lower mold 60*b* such that the longitudinal direction thereof is parallel to the front-back direction, and communicates the runner 63 with the back portion of the casting main body portion 62.

The second weir 64*b* is a passage for supplying molten metal circulated through the runner 63 to the inside of the casting main body portion 62. The second weir 64*b* is formed in the lower mold 60*b* such that the longitudinal direction thereof is parallel to the left-right direction, and communicates the runner 63 with a neighborhood of the back end portion of the right side portion of the casting main body portion 62.

The third weir 64*c* is a passage for supplying molten metal circulated through the runner 63 to the inside of the casting main body portion 62. The third weir 64*c* is formed in the lower mold 60*b* such that the longitudinal direction thereof is parallel to the left-right direction, and communicates the runner 63 with a neighborhood of the front end portion of the right side portion of the casting main body portion 62.

The gas vent portion 65 is a passage for discharging gas that occurs inside the mold 60 when the bearing housing 20 is manufactured by casting. One end of the gas vent portion 65 is communicatively connected to the casting main body portion 62, and the other end of the gas vent portion 65 is communicated with the upper surface of the upper mold 60*a*.

The riser portion 66 is a pool of molten metal that prevents the occurrence of a cavity in the bearing housing 20 when the bearing housing 20 is manufactured by casting. The riser portion 66 is formed at the upper potion of the casting main body portion 62 (more specifically, above a portion in which the circular circulation portion 33*a* of the cooling passage 33 of the bearing housing 20 is formed), and is communicatively connected to the casting main body portion 62.

A collapsible core 50 is disposed inside the casting main body portion 62. Hereinafter, with reference to FIG. 6 and FIG. 7, description will be given of a configuration of the collapsible core 50.

The collapsible core 50 is for forming the cooling passage 33 inside the bearing housing 20. The collapsible core 50 is formed from molding sand and a resin binder. The collapsible core 50 mainly includes a circulation forming portion 51, a one end forming portion 52, an other end forming portion 53, and a fixing portion 54.

The circulation forming portion 51 is a portion corresponding to the circular circulation portion 33*a* of the cooling passage 33, and is a portion for forming the circular circulation portion 33*a*. The circulation forming portion 51 has substantially the same shape as the circular circulation portion 33*a* of the cooling passage 33, namely formed into a substantially arc shape in the front view.

The one end forming portion 52 is one embodiment of the end part forming portion according to the present invention. The one end forming portion 52 is a portion corresponding to the first end portion 33*b* of the cooling passage 33, and is a portion for forming the first end portion 33*b*. The one end forming portion 52 has substantially the same shape as the first end portion 33*b* of the cooling passage 33. Specifically, one end of the one end forming portion 52 is integrally connected to the one end of the circulation forming portion 51 (end portion on the right side), the other end of the one end forming portion 52 is extended downward and backward from the one end of the circulation forming portion 51.

The other end forming portion 53 is one embodiment of the end part forming portion according to the present invention. The other end forming portion 53 is a portion corresponding to the second end portion 33*c* of the cooling passage 33, and is a portion for forming the second end portion 33*c*. The other end forming portion 53 has substantially the same shape as the second end portion 33*c* of the cooling passage 33. Specifically, one end of the other end forming portion 53 is integrally connected to the other end of the circulation forming portion 51 (end portion on the left side), the other end of the other end forming portion 53 is extended downward and backward from the other end of the circulation forming portion 51. The other end of the other end forming portion 53 is extended to a position close to the other end of the one end forming portion 52 (more specifically, just left direction of the other end of the one end forming portion 52).

As described above, each of the end portions of the one end forming portion 52, the circulation forming portion 51, and the other end forming portion 53 is sequentially connected with each other so that the one end forming portion 52, the circulation forming portion 51, and the other end forming portion 53 are formed to be one continuous linear form having no branch.

The fixing portion 54 is for holding the one end forming portion 52 and the other end forming portion 53 in a position close to each other. The fixing portion 54 has a substantially rectangular parallelepiped shape. On the one surface (upper surface) of the fixing portion 54, in which the other end of the one end forming portion 52 and the other end of the other end forming portion 53 are fixed in a position close to each other.

Figure 7A:
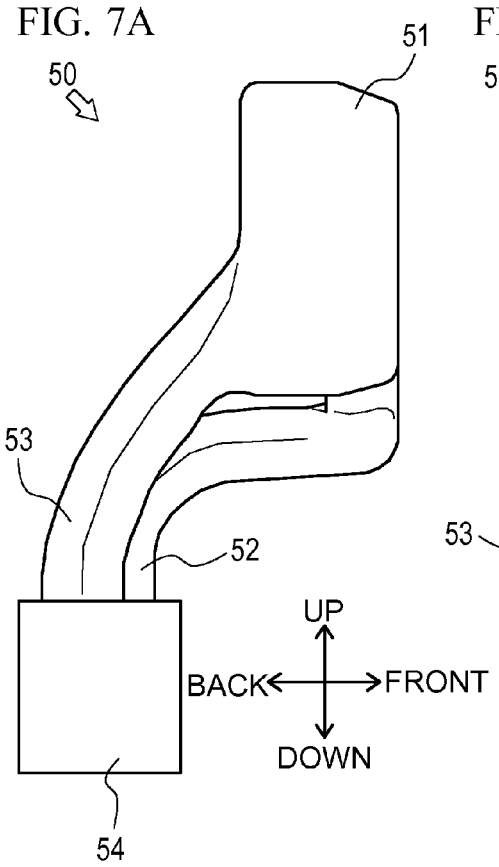
FIG. 7A is a right-side view of the collapsible core.
Figure 7B:
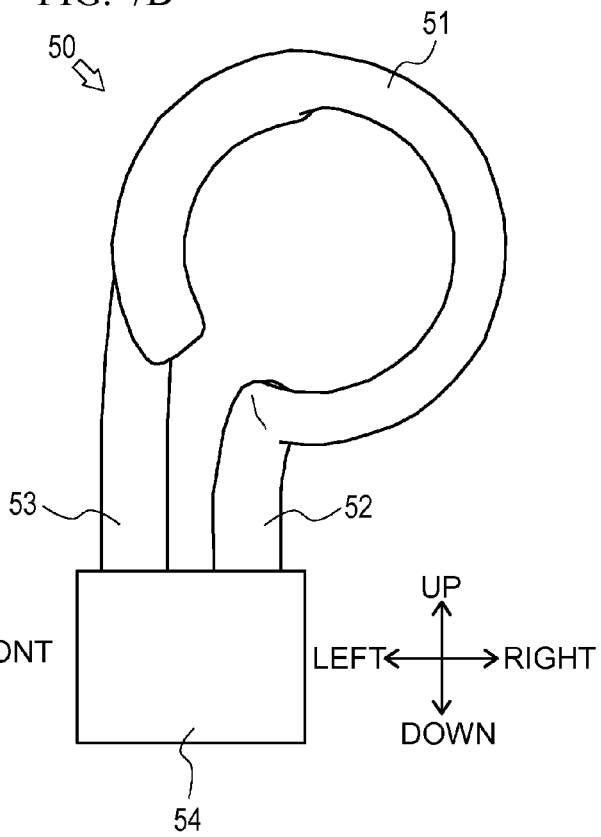
FIG. 7B is a front view of the collapsible core.
Figure 7C:
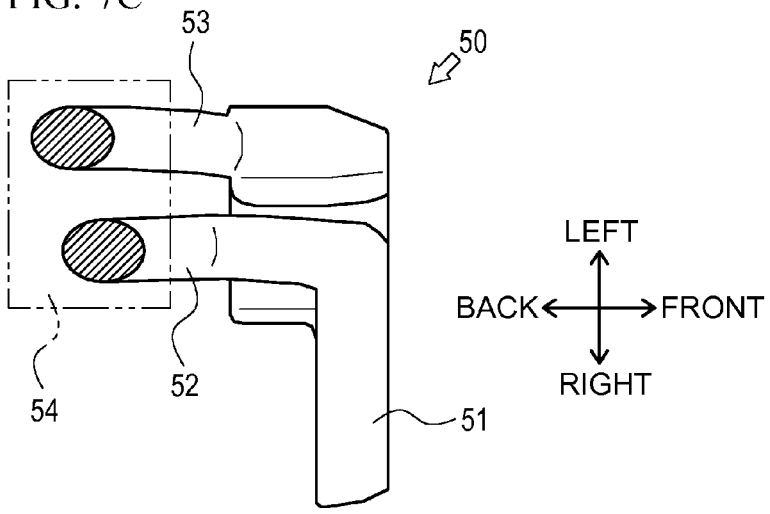
FIG. 7C is a bottom view of the collapsible core.

The collapsible core 50 configured as above has a shape gradually protruding forward from the fixing portion 54 to the circulation forming portion 51 (refer to FIG. 7A).

Each of the cross-sections of the one end forming portion 52 and the other end forming portion 53 has a substantially elliptical shape. More specifically, each of the cross-sections of the one end forming portion 52 and the other end forming portion 53 has a substantially elliptical shape such that the long axis thereof is substantially parallel to the front-back direction (specifically, a direction in which the collapsible core 50 protrudes forward from the fixing portion 54 to the circulation forming portion 51), and the short axis thereof is substantially parallel to the left-right direction (specifically, the direction in which the one end forming portion 52 and the other end forming portion 53 are lined up).

The collapsible core 50 configured as above is disposed inside of the casting main body portion 62 in the mold 60. More specifically, as shown in FIG. 4, FIG. 5, and FIG. 8, the collapsible core 50 is disposed such that the fixing portion 54 is disposed on the lower side and the circulation forming portion 51 is disposed on the upper side. The fixing portion 54 is embedded in and fixed to the bottom portion (lower portion) of the casting main body portion 62.

As described above, the fixing portion 54 of the collapsible core 50 is fixed to the inside of the casting main body portion 62 so that the circulation forming portion 51, the one end forming portion 52, and the other end forming portion 53 can be retained at a prescribed position. Specifically, the circulation forming portion 51 is disposed at a position surrounding a periphery of the bearing portion 31 formed in the bearing housing 20.

Further, the one end forming portion 52 and the other end forming portion 53 of the collapsible core 50 are disposed so as not to overlap with an extension line in the longitudinal direction (left-right direction) of the second weir 64*b* in the plan view (refer to FIG. 5). Specifically, the collapsible core 50 is disposed such that after circulating into the inside of the second weir 64*b* and flowing out from a left end portion of the second weir 64*b* to the inside of the casting main body portion 62, molten metal does not directly come into contact with the one end forming portion 52 and the other end forming portion 53 of the collapsible core 50 maintaining the vigorousness.

Next, with reference to FIG. 4, FIG. 5, and FIG. 8, description will be given of the method for manufacturing the bearing housing 20 using the mold 60 and the collapsible core 50 configured as above.

When the bearing housing 20 is manufactured, the molten metal 70 is poured from the sprue 61 (refer to FIG. 4 and FIG. 5). The molten metal 70 poured from the sprue 61 circulates into the runner 63, and is supplied (cast in the mold) to the casting main body portion 62 via the first weir 64*a*, the second weir 64*b*, and the third weir 64*c*.

Thus, a plurality of weirs (the first weir 64*a*, the second weir 64*h*, and the third weir 64*c*) are formed in the mold 60 and molten metal supplied from the runner 63 is distributed to the each weir, so that the amount of molten metal circulating inside the each weir can be reduced. Accordingly, it is possible to reduce a shock given to the collapsible core 50 when molten metal circulating into the inside of the each weir and flowing out to the inside of the casting main body portion 62 hits the collapsible core 50.

Further, molten metal circulating into the inside of the second weir 64*b* and flowing out to the inside of the casting main body portion 62 does not hit the collapsible core 50 directly (specifically, the one end forming portion 52 and the other end forming portion 53), and therefore a shock given to the collapsible core 50 can be much more reduced.

Figure 8B:
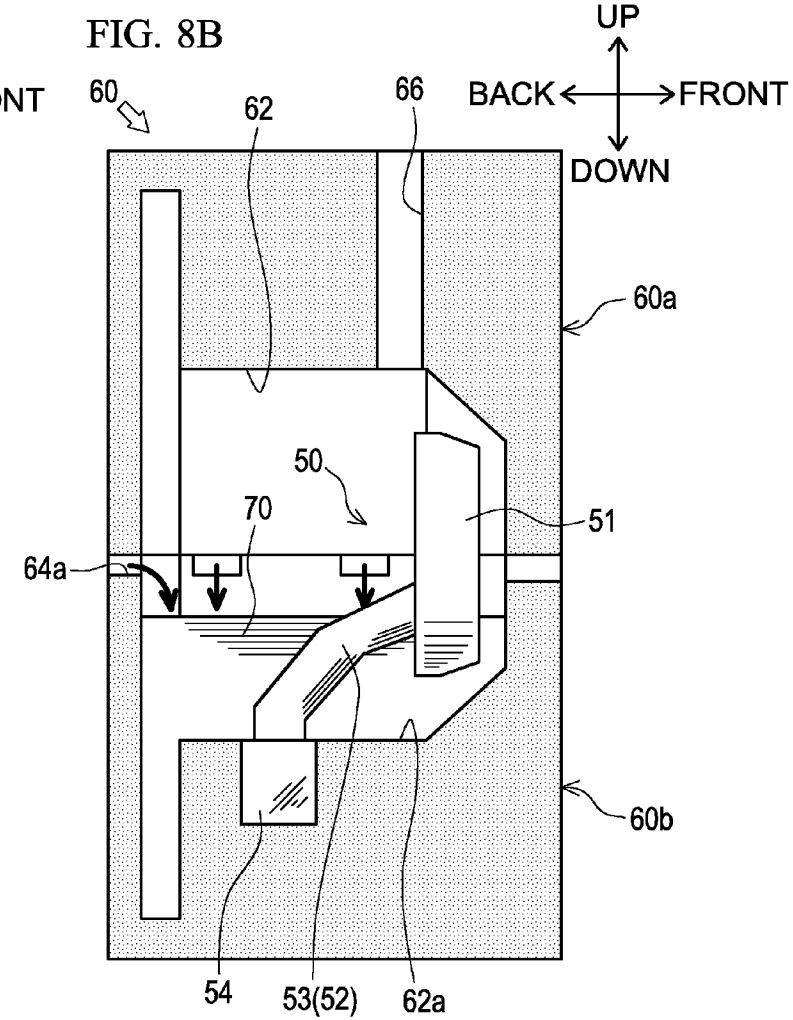
FIG. 8B is a sectional side view of the inside of the casting main body portion when a fixed time elapses after molten metal starts to be supplied to the casting main body portion.
Figure 8A:
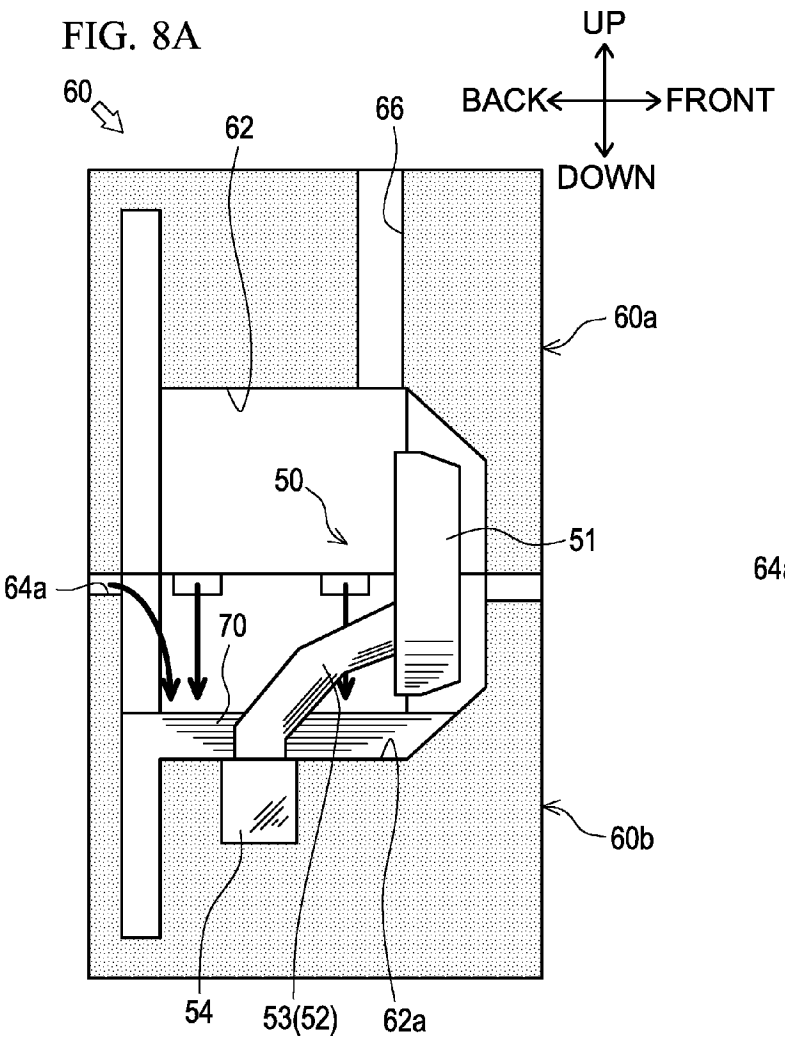
FIG. 8A is a sectional side view of the inside of a casting main body portion when molten metal starts to be supplied to the casting main body portion.
Figure 9B:
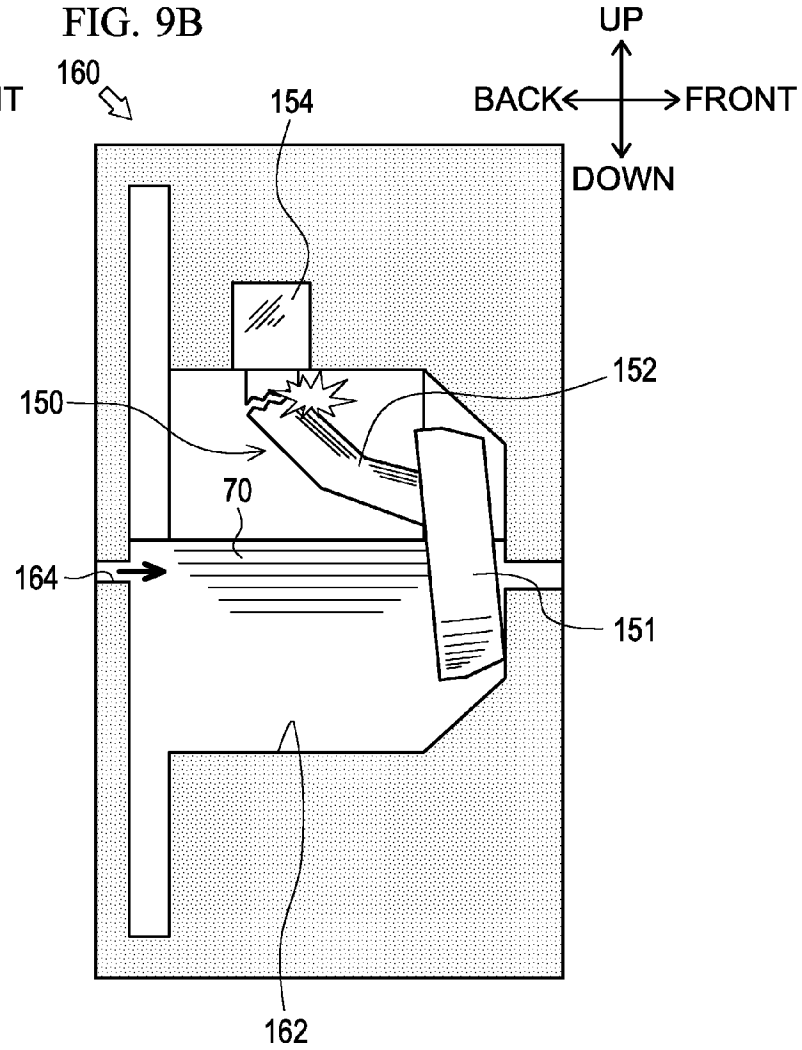
FIG. 9B is a sectional side view of the inside of the conventional casting main body portion when molten metal is supplied to the conventional casting main body portion.
Figure 9A:
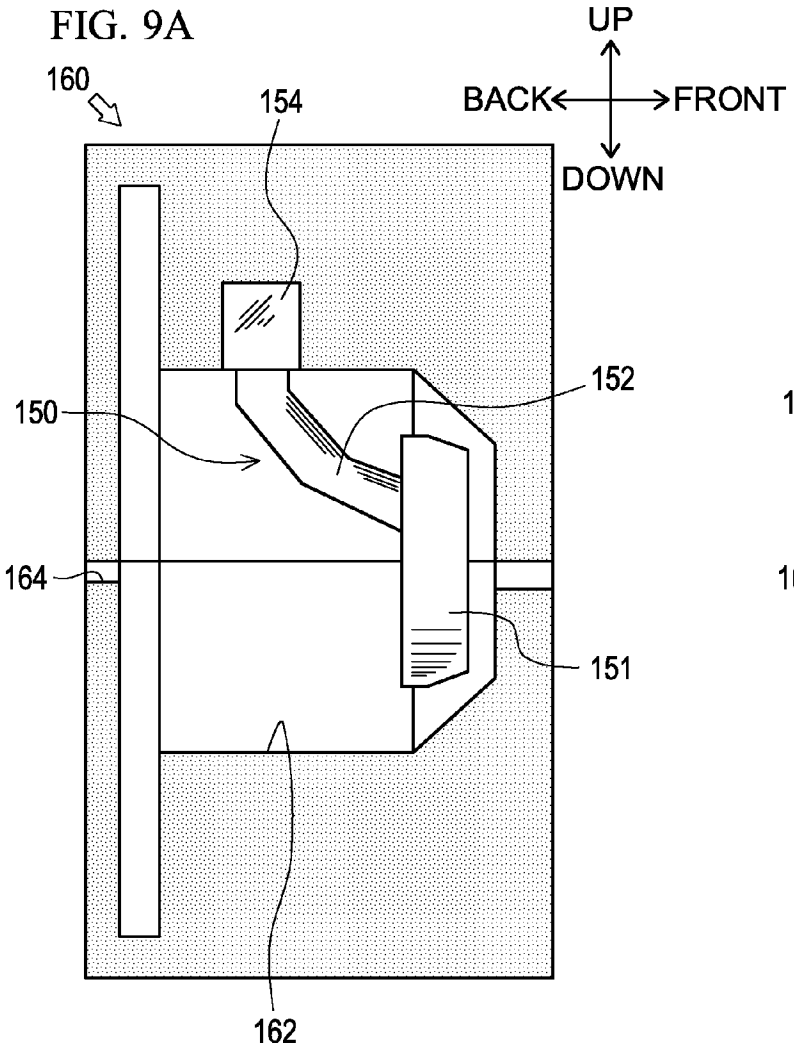
FIG. 9A is a sectional side view of the inside of a conventional casting main body portion.
Figure 10:
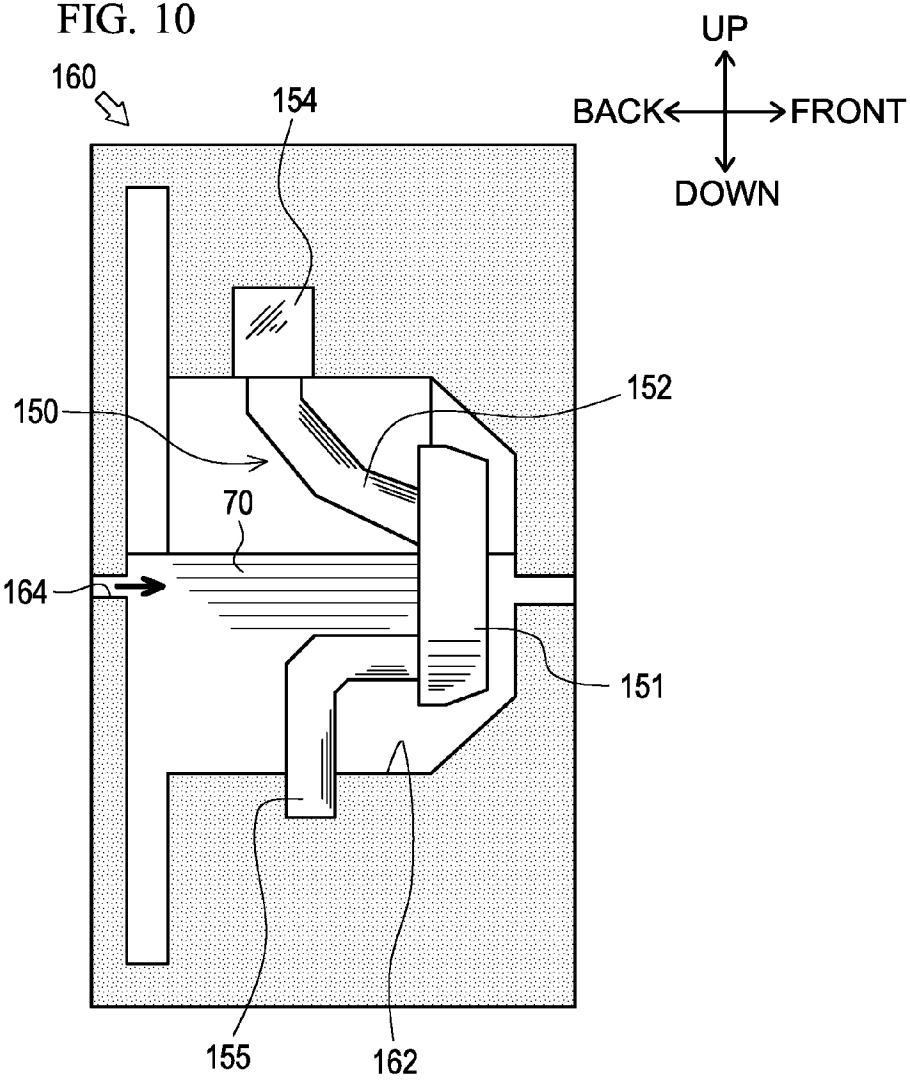
FIG. 10 is a sectional side view of the inside of the conventional casting main body portion configured to support the collapsible core in a both-end support manner.

As shown in FIG. 8A, the molten metal 70 supplied to the casting main body portion 62 is accumulated at the lower portion of the casting main body portion 62. The molten metal 70 is accumulated at the lower portion of the casting main body portion 62 so that the lower portion of the collapsible core 50, namely each of the lower portions of the one end forming portion 52 and the other end forming portion 53 is submerged into the molten metal 70. Since the temperature of the molten metal 70 accumulated in the casting main body portion 62 becomes low and the molten metal 70 begins to solidify (coagulate), the molten metal 70 begins to fix each of the lower portions of the one end forming portion 52 and the other end forming portion 53.

As shown in FIG. 8B, the molten surface (upper surface of molten metal stored inside the casting main body portion 62) rises as the molten metal 70 is supplied to the casting main body portion 62. When the molten surface of the molten metal 70 rises, not only the one end forming portion 52 and the other end forming portion 53 but also the circulation forming portion 51 is submerged into the molten metal 70.

In the case where the circulation forming portion 51 having a large volume is submerged into the molten metal 70, large buoyancy is applied to the circulation forming portion 51. However, since each of the lower portions of the one end forming portion 52 and the other end forming portion 53 begins to be solidified by the molten metal 70 beginning to coagulate, point which applies the moment of force to the one end forming portion 52 and the other end forming portion 53 (point of action of the moment of force) gradually moves over the one end forming portion 52 and the other end forming portion 53 toward the front direction. Accordingly, since distance in the front-back direction between the point of action and the circulation forming portion 51 gradually becomes short, the moment of force applied to the one end forming portion 52 and the other end forming portion 53 gradually becomes small in accordance with buoyancy applied to the circulation forming portion 51. Thus, the one end forming portion 52 and the other end forming portion 53 can be prevented from being damaged (broken) by buoyancy applied to the circulation forming portion 51.

Each of the cross-sections of the one end forming portion 52 and the other end forming portion 53 has a substantially elliptical shape such that the long axis thereof is parallel to the front-back direction. Accordingly, the strength to the moment of force in the up-down direction caused by buoyancy applied to the circulation forming portion 51 becomes high. Thus, the one end forming portion 52 and the other end forming portion 53 can be much more effectively prevented from being damaged (broken) by buoyancy applied to the circulation forming portion 51.

The molten metal 70 is poured until the casting main body portion 62 and the riser portion 66 as shown in FIG. 4 are filled. The molten metal 70 can be supplied from the riser portion 66 to the casting main body portion 62 by filling the riser portion 66 with the molten metal 70. Accordingly, it is possible to prevent the occurrence of a cavity in a neighborhood of the collapsible core 50 (specifically, an upper portion of the circulation forming portion 51) by gas occurred inside the collapsible core 50 or shrinkage of the molten metal 70.

After the completion of pouring molten metal into the inside of the mold 60 and the molten metal 70 is cooled to a prescribed temperature, the mold 60 is broken (mold shakeout) and the molten metal 70 (casting) coagulated inside the mold 60 is taken out. The bearing housing 20 is formed by performing a predetermined processing (machining such as cutting or grinding) to the casting main body portion 62 after only the casting main body portion 62 is separately taken out from the taken out casting and the collapsible core 50 is removed from the casting main body portion 62.

As described above, the method for manufacturing the bearing housing 20 of the turbocharger 10 according to the present embodiment is that the bearing housing 20 of the turbocharger 10 is formed with the cooling passage 33 for circulating cooling liquid by casting using the collapsible core 50. The collapsible core 50 includes the end part forming portions corresponding to the end portions of the cooling passage 33 and having a substantially elliptical cross-section (the one end forming portion 52 and the other end forming portion 53), and the fixing portion 54 holding the end part forming portions and being embedded in the mold 60 and fixed to the mold 60.

With this configuration, the strength of the end part forming portions of the collapsible core 50 can be improved and the end part forming portions can be prevented from being damaged by buoyancy applied to the collapsible core 50 from the molten metal 70.

Further, there is no necessity to increase the amount of a resin binder of the collapsible core 50 or to pass a cored bar to the collapsible core 50 in order to improve the strength of the collapsible core 50 (more specifically, end part forming portions). Thus, it is possible to prevent the increase of the gas generation amount in association with the increase of the resin binder (furthermore, occurrence of a casting defect), and to prevent the increase of man-hours for passing the cored bar and for removing the cored bar.

Further, it is possible to increase the cross-sectional area of the cooling passage 33, and thereby sand of the collapsible core 50 can be easily removed from the inside of the cooling passage 33 after the molten metal 70 is solidified.

The end part forming portions include the one end forming portion 52 corresponding to the first end portion 33*b* of the cooling passage 33 (one of end portions) and the other end forming portion 53 corresponding to the second end portion 33*c* of the cooling passage 33 (other end portion). The fixing portion 54 holds the one end forming portion 52 and the other end forming portion 53 in a position close to each other. The collapsible core 50 connects the one end forming portion 52 with the other end forming portion 53, and further includes the circulation forming portion 51 corresponding to the circular circulation portion 33*a* of the cooling passage 33 (middle portion). The one end forming portion 52, the circulation forming portion 51, and the other end forming portion 53 are formed to be one continuous linear form.

With this configuration, the collapsible core 50 is supported, from one direction (specifically, supported at one end), by a portion corresponding to both end portions of the cooling passage 33 (the one end forming portion 52 and the other end forming portion 53). Accordingly, it is possible to prevent unnecessary holes from being formed, the unnecessary holes being formed in the bearing housing 20 when the collapsible core 50 is supported in a plurality of directions (for example, supported in two directions, namely supported at both ends, and so on).

Further, since it is possible to prevent the unnecessary holes from being formed in the bearing housing 20, there is no necessity to use a plug for blocking a hole and a bond for preventing water leakage, and so on for the unnecessary holes. Thus, cost reduction can be achieved. Further, since there is no necessity to form a boss portion for attaching the plug, the plug itself is also unnecessary. Accordingly, the increase of the weight of the bearing housing 20 can be prevented. Further, since there is no necessity to form the boss portion, it is possible to improve the degree of freedom in designing such as enlarging the lubricating oil passage 32 formed in addition to the cooling passage 33.

Further, in the case where the collapsible core 50 is supported in a plurality of directions, the shape of the cooling passage 33 becomes complicated, and a dead end portion is formed in the cooling passage 33. Accordingly, the circulation of cooling liquid is stagnated in the dead end portion, thereby lowering the cooling efficiency of the bearing housing 20. However, in the bearing housing 20 manufactured in accordance with the manufacturing method according to the present invention, since the cooling passage 33 has a simple shape (one linear form having no branch), cooling liquid can be circulated smoothly, and this the cooling efficiency can be increased.

Each of the end part forming portions is formed so as to have a substantially elliptical cross-section such that the short axis thereof is parallel to the direction (left-right direction) in which the one end forming portion 52 and the other end forming portion 53 are lined up.

With this configuration, the strength of the end part forming portions of the collapsible core 50 (the one end forming portion 52 and the other end forming portion 53) can be improved while ensuring an interval between the one end forming portion 52 and the other end forming portion 53, which are adjacent to each other.

In the method for manufacturing the bearing housing 20 of the turbocharger 10 according to the present embodiment, the collapsible core 50 is disposed such that the fixing portion 54 is disposed on the lower side and the circulation forming portion 51 is disposed on the upper side, the fixing portion 54 is fixed to a bottom portion 62*a* of the casting main body portion 62 (portion corresponding to the bearing housing 20 of the mold 60), and the molten metal 70 is cast in the casting main body portion 62.

With this configuration, when the molten metal 70 is cast in the casting main body portion 62, it is possible to reduce buoyancy applied to the circulation forming portion 51 of the collapsible core 50 from the molten metal 70, further to prevent the collapsible core 50 from being damaged (specifically, one end forming portion 52 and the other end forming portion 53).

The method for manufacturing the bearing housing 20 of the turbocharger 10 according to the present embodiment is that the casting main body portion 62 (portion corresponding to the bearing housing 20 of the mold 60) is formed with a plurality of weirs for supplying the molten metal 70 (the first weir 64*a*, the second weir 64*b*, and the third weir 64*c*). One of the plurality of weirs (second weir 64*b*) is formed in a portion in which the molten metal 70 supplied from the second weir 64*b* to the casting main body portion 62 (portion corresponding to the bearing housing 20 of the mold 60) does not contact with the end part forming portions (the one end forming portion 52 and the other end forming portion 53).

With this configuration, when the molten metal 70 is supplied from the plurality of weirs, it is possible to reduce a shock (pressure) that the collapsible core 50 receives from the molten metal 70, further to prevent the collapsible core 50 from being damaged (specifically, the end part forming portions (the one end forming portion 52 and the other end forming portion 53)).

The bearing housing 20 of the turbocharger 10 according to the present embodiment is formed, inside thereof, with the cooling passage 33 for circulating cooling liquid by casting using the collapsible core 50. The end portions of the cooling passage 33 (the first end portion 33*b* and the second end portion 33*c*) apertured on the outer peripheral surface (bottom surface) of the bearing housing 20 are formed so as to have a substantially elliptical cross-section.

With this configuration, it is possible to improve the strength of the portions (the one end forming portion 52 and the other end forming portion 53) corresponding to the end portions of the cooling passage 33 of the collapsible core 50 (the first end portion 33*b* and the second end portion 33*c*). Thereby, the portions corresponding to the end portions of the cooling passage 33 of the collapsible core 50 can be prevented from being damaged by buoyancy applied to the collapsible core 50 from the molten metal 70 at the time of casting.

Further, there is no necessity to increase the amount of a resin binder of the collapsible core 50 or to pass a cored bar to the collapsible core 50 in order to improve the strength of the collapsible core 50 (more specifically, the portions corresponding to the end portions of the cooling passage 33 of the collapsible core 50). Thus, it is possible to prevent the increase of the gas generation amount in association with the increase of the resin binder (furthermore, occurrence of a casting defect), and to prevent the increase of man-hours for passing the cored bar and for removing the cored bar.

Further, it is possible to increase the cross-sectional area of the cooling passage 33, and thereby sand of the collapsible core 50 can be easily removed from the inside of the cooling passage 33 after the molten metal 70 is solidified.

The cooling passage 33 includes the first end portion 33*b* and the second end portion 33*c* (both end portions) apertured at a position close to each other on the outer peripheral surface (bottom surface) of the bearing housing 20, and the circular circulation portion 33*a* (middle portion) connecting with both end portions inside of the bearing housing 20. Both end portions and the circular circulation portion 33*a* are formed so as to be one continuous linear form.

With this configuration, the collapsible core 50 is supported, from one direction (specifically, supported at one end), by a portion corresponding to both end portions of the cooling passage 33 (the one end forming portion 52 and the other end forming portion 53). Accordingly, it is possible to prevent unnecessary holes from being formed, the unnecessary holes being formed in the bearing housing 20 when the collapsible core 50 is supported in a plurality of directions (for example, supported in two directions, namely supported at both ends, and so on).

Further, since it is possible to prevent the unnecessary holes from being formed in the bearing housing 20, there is no necessity to use a plug for blocking a hole, a bond for preventing water leakage, and so on for the unnecessary holes. Thus, cost reduction can be achieved. Further, since there is no necessity to form a boss portion for attaching the plug, the plug itself is also unnecessary. Accordingly, the increase of the weight of the bearing housing 20 can be prevented. Further, since there is no necessity to form the boss portion, it is possible to improve the degree of freedom in designing such as enlarging the lubricating oil passage 32 formed in addition to the cooling passage 33.

Further, in the case where the collapsible core 50 is supported in a plurality of directions, the shape of the cooling passage 33 becomes complicated and a dead end portion is formed in the cooling passage 33. Accordingly, the circulation of cooling liquid is stagnated in the dead end portion, thereby lowering the cooling efficiency of the bearing housing 20. However, in the bearing housing 20 according to the present invention, since the cooling passage 33 has a simple shape (one linear form having no branch), cooling liquid can be circulated smoothly, and thus the cooling efficiency can be increased.

Each of the both end portions of the cooling passage 33 (the first end portion 33*b* and the second end portion 33*c*) is formed so as to have a substantially elliptical cross-section such that the short axis thereof is parallel to the direction (left-right direction) in which both end portions are lined up.

With this configuration, it is possible to improve the strength of a portion (the one end forming portion 52 and the other end forming portion 53) corresponding to both end portions (the first end portion 33*b* and the second end portion 33*c*) of the cooling passage 33 of the collapsible core 50 while ensuring an interval between the adjacent both end portions (the first end portion 33*b* and the second end portion 33*c*) of the cooling passage 33.

Each of the cross-sections of the one end forming portion 52 and the other end forming portion 53 of the collapsible core 50 is formed so as to have a substantially elliptical shape such that the long axis thereof is substantially parallel to the direction (front-back direction in the present embodiment) in which the collapsible core 50 protrudes forward from the fixing portion 54 to the circulation forming portion 51.

With this configuration, the strength of the one end forming portion 52 and the other end forming portion 53 can be improved against the moment of force in the up-down direction caused by buoyancy applied to the circulation forming portion 51 while ensuring an interval between the one end forming portion 52 and the other end forming portion 53, which are disposed side by side in the left-right direction (since the short axis thereof is directed toward left-right direction, the one end forming portion 52 and the other end forming portion 53 do not close to each other).

In the present embodiment, only the second weir 64*b* among a plurality of weirs (the first weir 64*a*, the second weir 64*b*, and the third weir 64*c*) is formed in a position in which the molten metal 70 supplied from the second weir 64*b* to the casting main body portion 62 do not contact with the collapsible core 50 (more specifically, the one end forming portion 52 and the other end forming portion 53). However, the present invention is not limited to this embodiment. Specifically, there may be a configuration in which the molten metal 70 supplied from other weirs (the first weir 64*a* or the third weir 64*c*) to the casting main body portion 62 does not contact with the collapsible core 50 directly. Further, there may be a configuration in which the molten metal 70 supplied from a plurality of weirs to the casting main body portion 62 does not contact with the collapsible core 50 directly.

Further, in the present embodiment, the mold 60 is formed with three weirs as a plurality of weirs, namely the first weir 64*a*, the second weir 64*b*, and the third weir 64*c*. However, the present invention is not limited to this embodiment. Specifically, the number of weirs may be two or more than four.

INDUSTRIAL APPLICABILITY

The present invention can be applied to the method for manufacturing a turbocharger bearing housing in which a cooling passage for circulating cooling liquid is formed by casting using a collapsible core, and the turbocharger bearing housing.

REFERENCE SIGNS LIST

10 turbocharger
20 bearing housing
30 body portion
33 cooling passage
33*a* circular circulation portion (middle portion)
33*b* first end portion (one of end portions)
33*c* second end portion (other end portion)
50 collapsible core
51 circulation forming portion
52 one end forming portion (end part forming portion)
53 other end forming portion (end part forming portion)
54 fixing portion
60 mold
62 casting main body portion
62*a* bottom portion
64*a* first weir (weir)
64*b* second weir (weir)
64*c* third weir (weir)

The invention claimed is:

1. A method for manufacturing a turbocharger bearing housing by casting in which a cooling passage for circulating cooling liquid is formed using a collapsible core, wherein the collapsible core includes:

end part forming portions formed so as to correspond to end portions of the cooling passage and formed so as to have a substantially elliptical cross-section; and a fixing portion holding the end part forming portions; the method comprising:

embedding the collapsible core in a mold such that the collapsible core is fixed to the mold; and casting the turbocharger bearing housing in the mold in which the collapsible core is embedded.

2. The method for manufacturing a turbocharger bearing housing according to claim 1, wherein the end portions of the cooling passage include a first end portion and a second end portion;

wherein the end part forming portions include a one end forming portion corresponding to the first end portion of the cooling passage and an other end forming portion corresponding to the second end portion of the cooling passage, wherein the fixing portion holds the one end forming portion and the other end forming portion in a position close to each other, wherein the collapsible core further includes a circulation forming portion which connects the one end forming portion and the other end forming portion, and corresponds to a middle portion of the cooling passage, and wherein the one end forming portion, the circulation forming portion, and the other end forming portion are formed so as to be continuous.

3. The method for manufacturing a turbocharger bearing housing according to claim 2, wherein each of the end part forming portions has a substantially elliptical cross-section such that a short axis thereof is parallel to a direction in which the one end forming portion and the other end forming portion are lined up.

4. The method for manufacturing a turbocharger bearing housing according to claim 2, wherein the collapsible core is disposed such that the fixing portion is disposed on a lower side and the circulation forming portion is disposed on an upper side, the fixing portion is fixed to a bottom portion of the mold that corresponds to a bottom portion of the bearing housing, and molten metal is cast in the mold.

5. The method for manufacturing a turbocharger bearing housing according to claim 4, wherein the mold is formed with a plurality of weirs for supplying molten metal at a portion corresponding to the bearing housing, and at least one of the plurality of weirs is formed in a position in which molten metal supplied from the weir to a portion corresponding to the bearing housing in the mold does not contact with the end part forming portions directly.

6. A turbocharger bearing housing being formed by casting, the turbocharger housing comprising:

a cooling passage for circulating cooling liquid, the cooling passage being formed by using a collapsible core, the cooling passage includes first and second end portions, and each of the end portions of the cooling passage open on an outer peripheral surface of the bearing housing, and each of the first and second end portions is formed so as to have a substantially elliptical cross-section.

7. The turbocharger bearing housing according to claim 6, wherein the cooling passage includes the first and second end portions apertured at a position close to each other on an outer peripheral surface of the bearing housing, and a middle portion for connecting the first and second end portions inside the bearing housing, and wherein the first and second end portions and the middle portion are formed so as to be continuous.

8. The turbocharger bearing housing according to claim 7, wherein the first and second end portions of the cooling passage have a substantially elliptical cross-section such that a short axis thereof is parallel to a direction in which the first and second end portions are lined up.

* * * * *